US010047494B2

(12) United States Patent
Goto et al.

(10) Patent No.: US 10,047,494 B2
(45) Date of Patent: Aug. 14, 2018

(54) HYDRAULIC CONTROL DEVICE AND CONSTRUCTION MACHINE WITH SAME

(71) Applicant: KOBELCO CONSTRUCTION MACHINERY CO., LTD., Hiroshima-shi (JP)

(72) Inventors: Naoki Goto, Hiroshima (JP); Koji Ueda, Hiroshima (JP); Kazuharu Tajima, Hiroshima (JP)

(73) Assignee: KOBELCO CONSTRUCTION MACHINERY CO., LTD., Hiroshima-shi (JP)

( * ) Notice: Subject to any disclaimer, the term of this patent is extended or adjusted under 35 U.S.C. 154(b) by 510 days.

(21) Appl. No.: 14/758,010

(22) PCT Filed: Dec. 20, 2013

(86) PCT No.: PCT/JP2013/007511
§ 371 (c)(1),
(2) Date: Jun. 26, 2015

(87) PCT Pub. No.: WO2014/103273
PCT Pub. Date: Jul. 3, 2014

(65) Prior Publication Data

US 2015/0354167 A1 Dec. 10, 2015

(30) Foreign Application Priority Data

Dec. 26, 2012 (JP) ..... 2012-282904

(51) Int. Cl.
*F15B 11/17* (2006.01)
*E02F 3/42* (2006.01)
(Continued)

(52) U.S. Cl.
CPC ..... *E02F 3/425* (2013.01); *E02F 3/32* (2013.01); *E02F 9/2235* (2013.01);
(Continued)

(58) Field of Classification Search
CPC ..... F15B 11/162; F15B 11/17; F15B 13/06; F15B 2211/30565; F15B 2211/781
See application file for complete search history.

(56) References Cited

U.S. PATENT DOCUMENTS 3,800,669 A * 4/1974 Distler ..... B62D 11/183 60/421
4,207,740 A * 6/1980 Ripa ..... E02F 3/42 137/596.13

(Continued)

FOREIGN PATENT DOCUMENTS

CN 101059138 A 10/2007
EP 1 793 128 A1 6/2007

(Continued)

OTHER PUBLICATIONS

International Search Report dated Jan. 21, 2014 in PCT/JP2013/007511 filed Dec. 20, 2013.

(Continued)

*Primary Examiner* — Michael Leslie
*Assistant Examiner* — Matthew Wiblin
(74) *Attorney, Agent, or Firm* — Oblon, McClelland, Maier & Neustadt, L.L.P.

(57) ABSTRACT

A boom cylinder circuit is provided with a boom control valve for controlling supply and discharge of hydraulic oil to and from a boom cylinder, and a merge switching valve operable to be switched between a supply position at which hydraulic oil is suppliable from a first hydraulic pump to the boom control valve, and a blocking position at which a flow of hydraulic oil is blocked. A controller switches the merge switching valve to the blocking position when a combined operation of a boom lowering operation and an arm pushing operation is detected by pilot pressure sensors, and switches the merge switching valve to the supply position when only one of the boom lowering operation and the arm pushing operation is detected.

6 Claims, 5 Drawing Sheets

(51) Int. Cl.
*F15B 13/06* (2006.01)
*E02F 9/22* (2006.01)
*E02F 3/32* (2006.01)

(52) U.S. Cl.
CPC ..... *E02F 9/2242* (2013.01); *E02F 9/2267* (2013.01); *E02F 9/2285* (2013.01); *E02F 9/2292* (2013.01); *E02F 9/2296* (2013.01); *F15B 11/17* (2013.01); *F15B 13/06* (2013.01); *F15B 2211/20538* (2013.01); *F15B 2211/20546* (2013.01); *F15B 2211/20576* (2013.01); *F15B 2211/30565* (2013.01); *F15B 2211/31535* (2013.01); *F15B 2211/411* (2013.01); *F15B 2211/41509* (2013.01); *F15B 2211/6313* (2013.01); *F15B 2211/665* (2013.01); *F15B 2211/71* (2013.01)

(56) References Cited

U.S. PATENT DOCUMENTS 4,212,165 A * 7/1980 Zirps ..... F15B 11/17 60/486
4,367,624 A * 1/1983 Ogata ..... E02F 3/844 60/484
6,581,506 B1 * 6/2003 Shimada ..... E02F 9/2225 91/513
2007/0045032 A1 * 3/2007 Brockmann ..... F15B 11/162 180/306
2007/0240562 A1 10/2007 Kim
2008/0314038 A1 12/2008 Tozawa et al.
2013/0330160 A1 12/2013 Oka

FOREIGN PATENT DOCUMENTS

JP 2000-145721 A 5/2000
JP 2004-36681 A 2/2004
JP 2005-256895 A 9/2005
JP 2006-90074 A 4/2006
JP 2010-190261 A 9/2010
JP 2012-77855 A 4/2012
JP 2012-172491 A 9/2012
JP 2012-247000 A 12/2012

OTHER PUBLICATIONS

Extended European Search Report dated Mar. 8, 2016 in Patent Application No. 13869346.0.

* cited by examiner

HYDRAULIC CONTROL DEVICE AND CONSTRUCTION MACHINE WITH SAME

TECHNICAL FIELD

The present invention relates to a hydraulic control device for controlling driving of a boom cylinder and an arm cylinder of a construction machine.

BACKGROUND ART

Conventionally, for instance, in a hydraulic excavator, a combined operation of a boom lowering operation and an arm pushing operation is performed in order to dump the soil from a bucket.

Normally, a boom cylinder for operating a boom, and an arm cylinder for operating an arm are driven by individual hydraulic pumps (a first hydraulic pump and a second hydraulic pump). On the other hand, when the aforementioned combined operation is performed, part of the oil from the first hydraulic pump for the boom cylinder is caused to merge with the arm cylinder by a merging valve for accelerating an arm pushing operation so as to enhance the work efficiency (see Patent Literature 1).

However, a boom lowering operation is a low load operation, as compared with an arm pushing operation, because the weight of the boom is added during the boom lowering operation. Therefore, in a combined operation of a boom lowering operation and an arm pushing operation, oil from the first hydraulic pump preferentially flows to the low-load boom cylinder.

As a result, redundant oil may flow to the boom cylinder, which may cause power loss. Further, the flow rate of oil to be supplied to the arm cylinder may decrease, which may hinder an intended object of accelerating the operation speed of the arm.

As a countermeasure against the above, there is proposed an idea of increasing the flow rate of oil ejected from the first hydraulic pump. This, however, may be disadvantageous in the point of energy efficiency, because the power of the first hydraulic pump increases.

CITATION LIST

Patent Literature

Patent Literature 1: Japanese Unexamined Patent Publication No. 2010-190261

SUMMARY OF INVENTION

An object of the invention is to provide a hydraulic control device that enables to securely cause hydraulic oil discharged from a first hydraulic pump to merge with an arm cylinder when a combined operation of an arm pushing operation and a boom lowering operation is performed, and enables to enhance the energy efficiency; and a construction machine with same.

In view of the above, the invention provides a hydraulic control device including a boom attached to a base machine to be operable to be raised and lowered by pivotal movement around a boom foot pin; an arm attached to a distal end of the boom to be operable to be pushed and pulled; a boom cylinder for raising and lowering the boom; an arm cylinder for pushing and pulling the arm; a first hydraulic pump and a second hydraulic pump as a hydraulic source of the boom cylinder and of the arm cylinder; a boom cylinder circuit for connecting the first hydraulic pump and the boom cylinder; an arm cylinder circuit for connecting the second hydraulic pump and the arm cylinder; a boom control valve disposed in the boom cylinder circuit, and configured to control supply and discharge of hydraulic oil to and from the boom cylinder; an arm control valve disposed in the arm cylinder circuit, and configured to control supply and discharge of hydraulic oil to and from the arm cylinder; a boom operation means for operating the boom control valve; an arm operation means for operating the arm control valve; a merging circuit connected to the boom cylinder circuit at a branch connection point upstream of the boom control valve in a state that the merging circuit is branched from the boom cylinder circuit, and configured to cause hydraulic oil discharged from the first hydraulic pump to merge with the arm cylinder; a boom operation detector for detecting a presence or absence of a boom lowering operation by the boom operation means; an arm operation detector for detecting a presence or absence of an arm pushing operation by the arm operation means; a merge switching valve disposed between the branch connection point of the merging circuit and the boom control valve in the boom cylinder circuit, and configured to be switchable between a supply position at which hydraulic oil is suppliable from the first hydraulic pump to the boom control valve, and a blocking position at which supply of hydraulic oil is blocked; a replenishing circuit having a replenishing valve for replenishing hydraulic oil in a tank to a rod side chamber of the boom cylinder; and a controller for switching the merge switching valve to the blocking position when a combined operation of a boom lowering operation and an arm pushing operation is detected by the boom operation detector and the arm operation detector.

Further, the invention provides a construction machine including a base machine; a boom attached to the base machine to be operable to be raised and lowered by pivotal movement around a boom foot pin; an arm attached to the boom to be operable to be pushed and pulled; and the hydraulic control device configured to control an operation of the boom and an operation of the arm.

According to the invention, it is possible to securely cause hydraulic oil discharged from the first hydraulic pump to merge with the arm cylinder when a combined operation of an arm pushing operation and a boom lowering operation is performed, and to enhance the energy efficiency.

DESCRIPTION OF EMBODIMENTS

Figure 1:
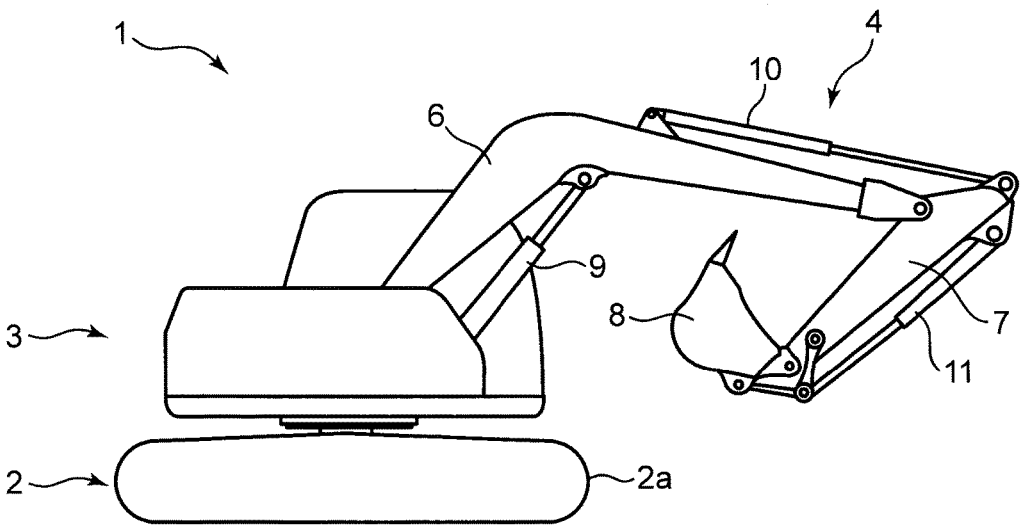
FIG. 1 is a right side view illustrating a hydraulic excavator in a first embodiment of the invention.

In the following, embodiments of the invention are described referring to the drawings. The following embodiments are merely examples embodying the invention, and do not limit the technical scope of the invention.

Figure 2:
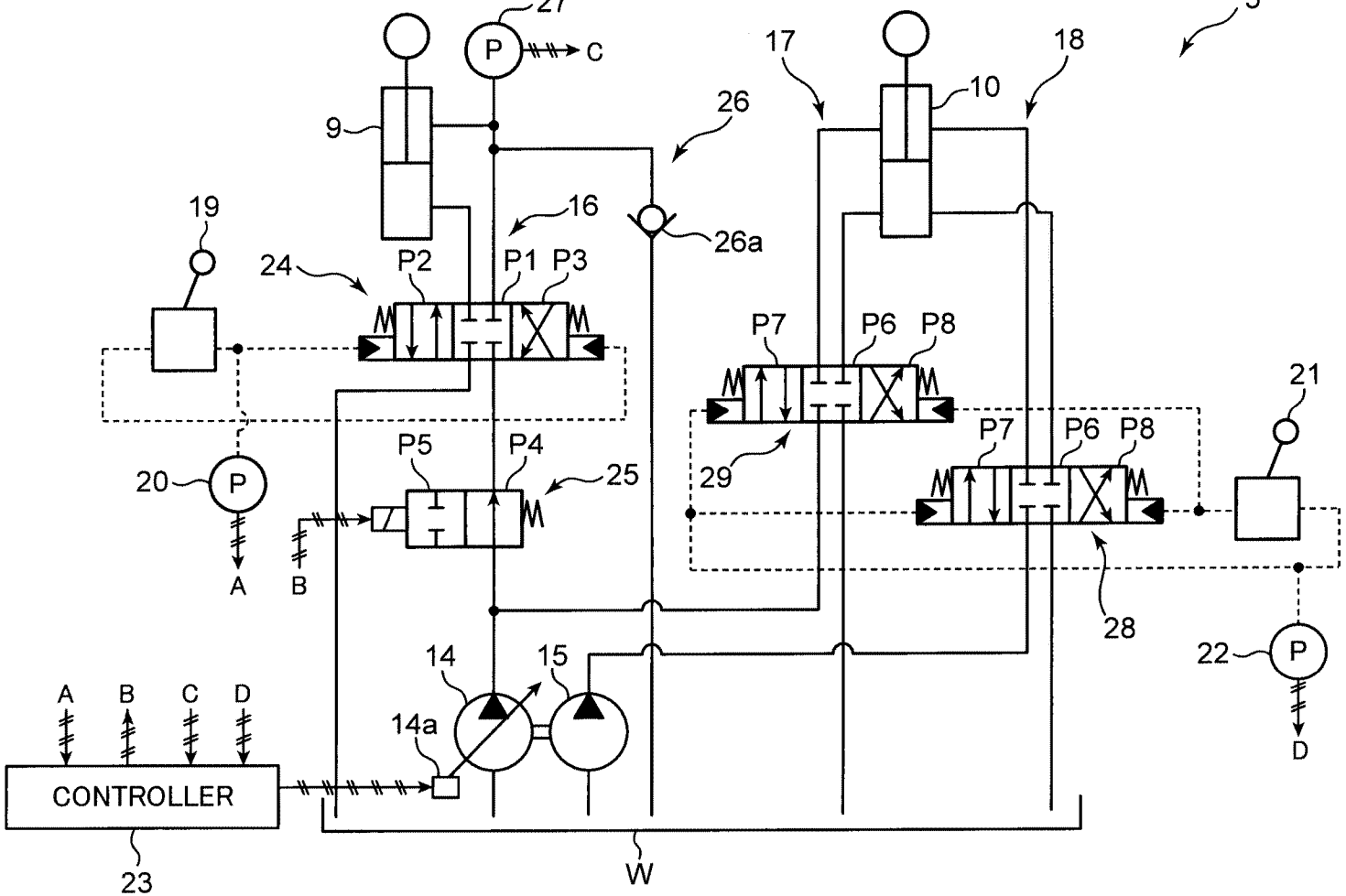
FIG. 2 is a circuit diagram illustrating a hydraulic control device of the hydraulic excavator illustrated in FIG. 1.
Figure 3:
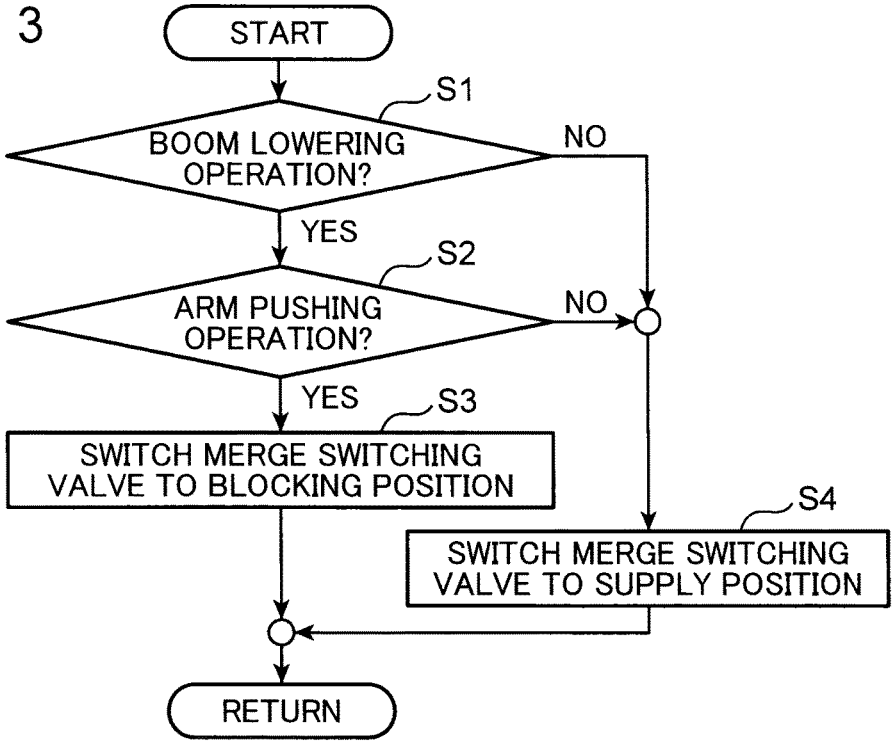
FIG. 3 is a flowchart illustrating a process to be executed by a controller illustrated in FIG. 2.

First Embodiment (FIGS. 1 to 3)

Referring to FIG. 1, a hydraulic excavator 1, as an example of a construction machine in the first embodiment, is provided with a base machine including a lower traveling body 2 having a crawler 2*a*, and an upper slewing body 3 provided on the lower traveling body 2 to be slewable around an axis perpendicular to the ground; an attachment 4 attached to be raised and lowered with respect to the upper slewing body 3; and a hydraulic control device 5 (see FIG. 2) for controlling an operation of the attachment 4.

The attachment 4 is provided with a boom 6 attached to be raised and lowered by pivotal movement around an unillustrated boom foot pin with respect to the upper slewing body 3, an arm 7 attached to a distal end of the boom 6 to be pivotally movable around a horizontal axis, and a bucket 8 attached to a distal end of the arm 7 to be pivotally movable around a horizontal axis.

Further, the attachment 4 is provided with a boom cylinder 9 for raising and lowering the boom 6 with respect to the upper slewing body 3, an arm cylinder 10 for pushing and pulling the arm 7, and a bucket cylinder 11 for pivotally moving the bucket 8 with respect to the arm 7.

In the following, the hydraulic control device 5 is described referring to FIG. 2.

The hydraulic control device 5 is provided with the boom cylinder 9, the arm cylinder 10, a first hydraulic pump 14 and a second hydraulic pump 15 to be driven by an unillustrated engine; a boom cylinder circuit 16 for connecting the first hydraulic pump 14 and the boom cylinder 9; an arm cylinder circuit 18 for connecting the second hydraulic pump 15 and the arm cylinder 10; a merging circuit 17 for branching oil discharged from the first hydraulic pump 14 from the boom cylinder circuit 16 for causing the discharged oil to merge with the arm cylinder circuit 18; a boom remote control valve 19 serving as a boom operation means and configured to raise and lower the boom 6; a pilot pressure sensor 20 serving as a boom operation detector and configured to detect the presence or absence of a boom lowering operation, and an operation amount of the boom lowering operation through a pilot pressure of the boom remote control valve 19; an arm remote control valve 21 serving as an arm operation means and configured to push and pull the arm 7; a pilot pressure sensor 22 serving as an arm operation detector and configured to detect the presence or absence of an arm pushing operation, and an operation amount of the arm pushing operation through a pilot pressure of the arm remote control valve 21; a replenishing circuit 26 including a replenishing valve 26*a* configured to suck hydraulic oil from a tank W into a rod side chamber of the boom cylinder 9, as necessary; and a controller 23.

The first hydraulic pump 14 is a capacity variable hydraulic pump including a pump regulator 14*a* capable of adjusting the capacity of the first hydraulic pump 14.

The boom cylinder circuit 16 is provided with a boom control valve 24 for controlling supply and discharge of hydraulic oil to and from the boom cylinder 9, a merge switching valve 25 disposed between the boom control valve 24 and the first hydraulic pump 14, and a pressure sensor 27 for detecting an inner pressure of the rod side chamber of the boom cylinder 9.

The boom control valve 24 has a neutral position P1 for use in stopping an operation of the boom cylinder 9, a boom lowering position P2 for use in lowering the boom 6 (for contracting the boom cylinder 9), and a boom raising position P3 for use in raising the boom 6 (for expanding the boom cylinder 9). The position of the boom control valve 24 is switched by the boom remote control valve 19.

The merge switching valve 25 is switchable between a supply position P4 at which hydraulic oil is suppliable from the first hydraulic oil pump 14 to the boom control valve 24, and a blocking position P5 at which supply of hydraulic oil is blocked. Further, the merge switching valve 25 is urged toward the supply position P4 in an ordinary state. A restriction may be disposed in a flow passage of the merge switching valve 25 at the supply position P4.

The replenishing valve 26*a* is a check valve for allowing hydraulic oil to flow from the tank W toward the boom cylinder 9, and for restricting hydraulic oil from flowing backward before the inner pressure of the rod side chamber of the boom cylinder 9 becomes a negative pressure.

The merging circuit 17 is connected to the boom cylinder circuit 16 at a position (branch connection point) between the first hydraulic pump 14 and the merge switching valve 25 in a state that the merging circuit 17 is branched from the boom cylinder circuit 16. According to this configuration, hydraulic oil discharged from the first hydraulic pump 14 is also guided to the arm cylinder 10.

Further, the merging circuit 17 is provided with a first arm control valve 29 for controlling supply and discharge of hydraulic oil to and from the arm cylinder 10.

Likewise, the arm cylinder circuit 18 is provided with a second arm control valve 28 for controlling supply and discharge of hydraulic oil to and from the arm cylinder 10. The second arm control valve 28 is disposed between the second hydraulic pump 15 and the arm cylinder 10.

Each of the first arm control valve 29 and the second arm control valve 28 has a neutral position P6 for use in stopping an operation of the arm cylinder 10, an arm pushing position P7 for use in causing the arm 7 to push (for contracting the arm cylinder 10), and an arm pulling position P8 for use in causing the arm 7 to pull (for expanding the arm cylinder 10). The position of each of the first arm control valve 29 and the second arm control valve 28 is switched by the arm remote control valve 21.

The controller 23 outputs a command B to a solenoid of the merge switching valve 25 and outputs a capacity command to the pump regulator 14*a* of the first hydraulic pump 14 based on a detection value A by the pilot pressure sensor 20, a detection value D by the pilot pressure sensor 22, and a detection value C by the pressure sensor 27.

In the following, a process to be executed by the controller 23 is described referring to FIG. 2 and FIG. 3

First of all, it is determined whether a boom lowering operation is performed by the pilot pressure sensor 20 (Step S1). When it is determined that a boom lowering operation is performed (YES in Step S1), it is determined whether an arm pushing operation is performed by the pilot pressure sensor 22 (Step S2).

Specifically, in Step S1 and in Step S2, it is determined whether a combined operation of a boom lowering operation and an arm pushing operation has been performed. When it is determined that a combined operation is performed (YES in Step S2), in response to an operation of retaining the merge switching valve 25 at the supply position P4, hydraulic oil discharged from the first hydraulic pump 14 may preferentially flow to the boom cylinder 9 rather than the arm cylinder 10. This is because a boom lowering operation is a relatively low load operation, as compared with an arm pushing operation.

In view of the above, when it is determined that a combined operation of a boom lowering operation and an arm pushing operation is performed, the merge switching valve 25 is switched to the blocking position P5 (Step S3). With the aforementioned control, a flow of hydraulic oil from the first hydraulic pump 14 to the boom cylinder 9 is blocked. This makes it possible to securely supply hydraulic oil from the first hydraulic pump 14 to the arm cylinder 10. When the merge switching valve 25 is switched to the blocking position P5, supply of hydraulic oil to the rod side chamber of the boom cylinder 9 is stopped. However, hydraulic oil is sucked from the tank W into the rod side chamber via the replenishing valve 26*a*. This makes it possible to prevent cavitation of the boom cylinder 9.

On the other hand, when it is determined to be "NO" in Step S1 and/or in Step S2, in other words, when it is determined that an operation other than a combined operation of a boom lowering operation and an arm pushing operation is performed, or when neither a boom lowering operation or an arm pushing operation is performed, the merge switching valve 25 is switched to the supply position P4 (to stop output of the command B: Step S4). With the aforementioned control, the controller 23 is brought to an ordinary circuit state except for a time when a combined operation of a boom lowering operation and an arm pushing operation is performed.

The ordinary circuit state includes a circuit state when a boom lowering operation is performed alone and when an arm pushing operation is performed alone. When the controller 23 is in the aforementioned state, it is possible to supply hydraulic oil discharged from the first hydraulic pump 14 to the boom cylinder 9 being operated or to the arm cylinder 10 being operated.

In Step S4, the merge switching valve 25 is switched to the supply position P4 in an operation state other than a state that a combined operation of a boom lowering operation and an arm pushing operation is performed. This makes it possible to supply hydraulic oil to the boom cylinder 9 even after an anomaly has occurred such that the controller 23 is unable to output a control signal B to the merge switching valve 25 in a state that an operation other than the combined operation is performed.

As described above, when a combined operation of a boom lowering operation and an arm pushing operation is detected, the merge switching valve 25 is switched to the blocking position P5. With the aforementioned control, when a combined operation is performed, supply of hydraulic oil from the first hydraulic pump 14 to the boom control valve 24 (boom cylinder 9) is stopped. Thus, it is possible to securely supply hydraulic oil from the first hydraulic pump 14 to the arm cylinder 10 via the merging circuit 17.

For instance, when a dump operation is performed, it is possible to sufficiently accelerate an arm pushing operation. Further, it is not necessary to excessively increase the capacity of the first hydraulic pump 14 (power of the first hydraulic pump 14). This is advantageous in energy saving.

Figure 4:
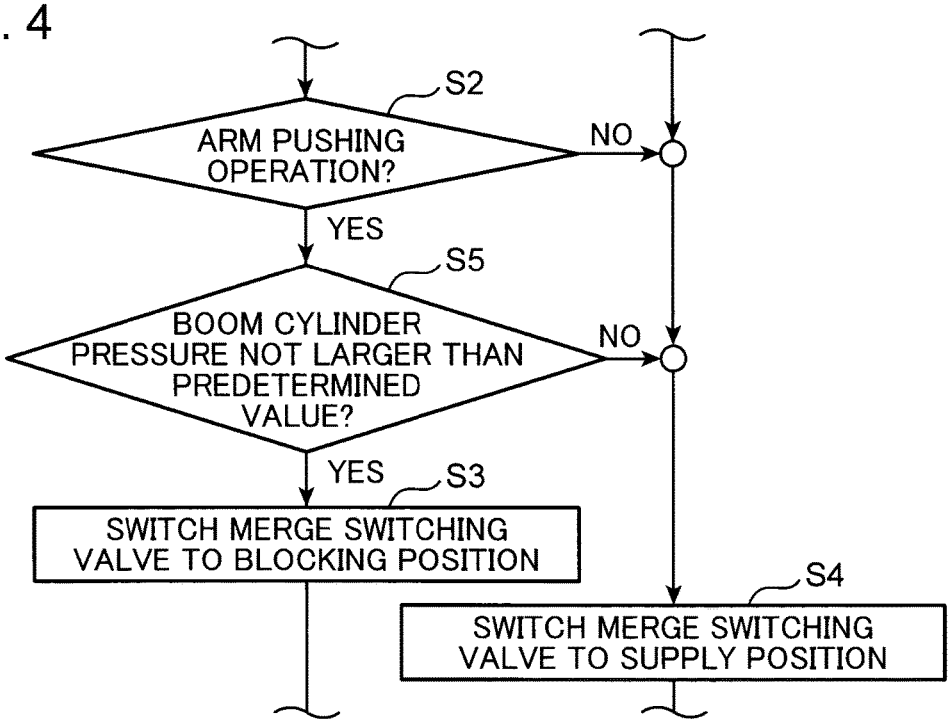
FIG. 4 is a flowchart illustrating a part of a process to be executed by a controller in a second embodiment of the invention.

Second Embodiment (FIG. 4)

In the first embodiment, the merge switching valve 25 is switched to the blocking position P5 when a combined operation of a boom lowering operation and an arm pushing operation is detected. Alternatively, it is possible that the load to be required for a boom cylinder 9 is considered as a condition for switching a merge switching valve 25.

In the following, a process to be executed by a controller 23 in the second embodiment is described referring to FIG. 4. Step S1 and Step S2 in the second embodiment are substantially the same as those in the first embodiment.

When a combined operation is detected (YES in Step S2), it is determined whether the inner pressure of a rod side chamber of the boom cylinder 9 is equal to or smaller than a predetermined value (reference pressure) by a pressure sensor 27 (Step S5).

Specifically, in Step S5, it is determined whether a force acting in a direction of lowering the boom cylinder 9 is required. For instance, when a ground leveling operation is performed on a slope (descending slope), a bucket 8 is moved along the slope while performing a combined operation of a boom lowering operation and an arm pushing operation. In this case, since it is necessary to press the bucket 8 against the slope, a force acting in a boom lowering direction is required.

When a force acting in a boom lowering direction is not required like a dump operation (YES in Step S5), the merge switching valve 25 is switched to a blocking position P5 (Step S3). On the other hand, when a force acting in a boom lowering direction is required (NO in Step S5), the merge switching valve 25 is switched to a supply position P4 (Step S4).

The second embodiment is advantageous in securely performing an operation of requiring a force acting in a boom lowering direction (an operation of exerting load on a boom cylinder), out of the operations to be performed by a combined operation of a boom lowering operation and an arm pushing operation.

Third Embodiment (FIG. 5 to FIG. 8)

As described above, in the first and second embodiments, switching the merge switching valve 25 to the blocking position makes it possible to prevent excessive supply of hydraulic oil to the boom cylinder 9 when a combined operation is performed. In the third embodiment to be described in the following, it is possible to save energy by restricting the capacity of a pump in a condition that a merge switching valve 25 is switched to a blocking position.

Figure 6:
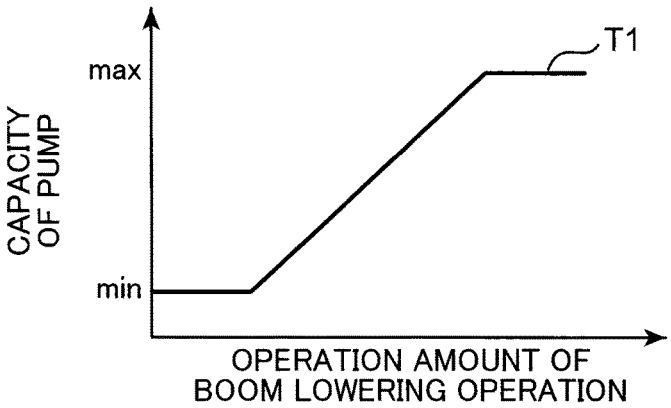
FIG. 6 is a graph illustrating boom lowering single operation characteristics for use in the process illustrated in FIG. 5.

Referring to FIG. 6, a controller 23 controls the capacity of a first hydraulic pump 14, based on boom single operation characteristics T1 such that the capacity increases as the operation amount of a boom remote control valve 19 increases when a boom lowering operation is performed alone.

Figure 7:
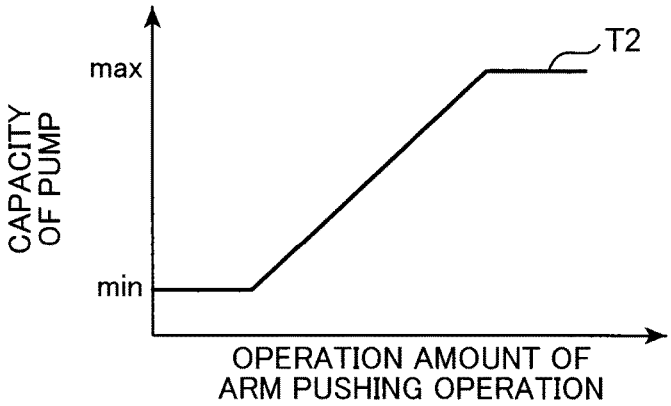
FIG. 7 is a graph illustrating arm pushing single operation characteristics for use in the process illustrated in FIG. 5.

Likewise, as illustrated in FIG. 7, the controller 23 controls the capacity of the first hydraulic pump 14, based on arm single operation characteristics T2 such that the capacity increases as the operation amount of an arm remote control valve 21 increases when an arm pushing operation is performed alone.

Figure 8:
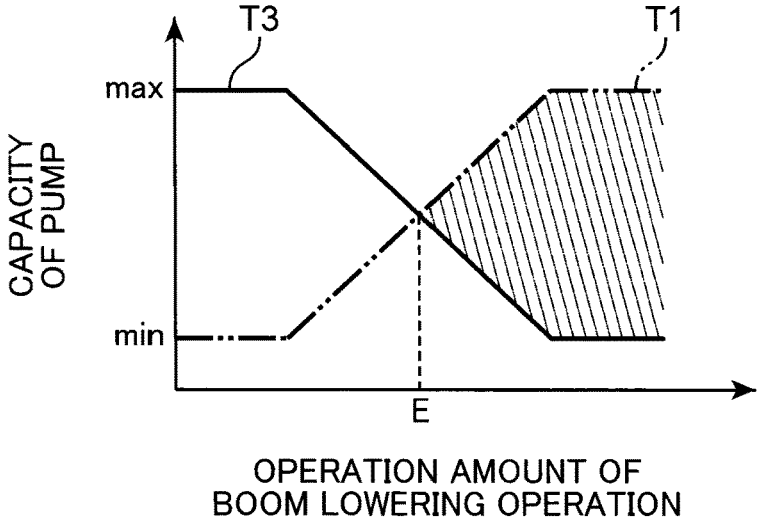
FIG. 8 is a graph illustrating combined operation characteristics for use in the process illustrated in FIG. 5.

On the other hand, as illustrated in FIG. 8, in a condition that the merge switching valve 25 is switched to the blocking position, the controller 23 determines the capacity of the first hydraulic pump 14, based on combined operation characteristics T3 such that the capacity decreases as the operation amount of the boom remote control valve 19 increases. The combined operation characteristics T3 are set as characteristics such that the relationship between the operation amount of the boom remote control valve 19 and the capacity in the boom single operation characteristics T1 is inverted with respect to a predetermined reference operation amount E.

According to this configuration, as illustrated by the hatched portion in FIG. 8, determining the capacity based on the combined operation characteristics T3 makes it possible to effectively restrict the capacity of the first hydraulic pump 14, as compared with a case, in which the capacity is determined based on the boom single operation characteristics T1. In other words, it is possible to restrict the capacity of the first hydraulic pump 14 in a range where a boom lowering operation amount is larger than the reference operation amount E.

Further, the controller 23 sets the smaller capacity out of the capacity based on the combined operation characteristics T3 and the capacity based on the arm single operation characteristics T2, as the capacity of the first hydraulic pump 14. This makes it possible to further reduce the capacity of the first hydraulic pump 14 when the operation amount of the arm remote control valve 21 is small. This is advantageous in enhancing the energy saving effect.

On the other hand, even when the operation amount of the arm remote control valve 21 is large, in some cases, the capacity of the first hydraulic pump 14 is restricted to be small depending on the operation amount of the boom remote control valve 19. This control is performed in order to simulate a state that hydraulic oil is excessively supplied from the first hydraulic pump 14 to the boom cylinder 9, like a conventional art. With the aforementioned control, it is possible to provide the operator with substantially the same sensation as if the operator is operating the construction machine in a conventional manner, while securing energy saving effect.

Figure 5:
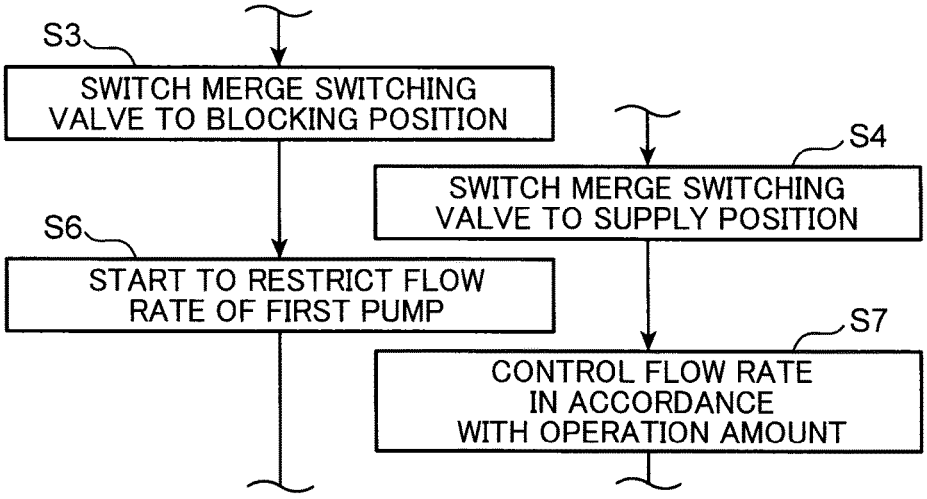
FIG. 5 is a flowchart illustrating a part of a process to be executed by a controller in a third embodiment of the invention.

As illustrated in Step S6 in FIG. 5, for instance, it is possible to restrict the capacity (flow rate) of the first hydraulic pump 14 after Step S3 of switching the merge switching valve 25 to the blocking position P5. On the other hand, it is possible to return the process to flow rate control in accordance with an operation amount (Step S7) after Step S4 of switching the merge switching valve 25 to the supply position P4.

Step S6 may be executed after Step S2 in the first embodiment (see FIG. 3), or after Step S5 but before Step S3 in the second embodiment (see FIG. 4).

Likewise, Step S7 may be executed after it is determined to be "NO" in Step S2 but before Step S4.

As illustrated in FIG. 6 to FIG. 8, in each of the characteristics T1 to T3, the expression "the capacity increases in accordance with an operation amount" means that a non-sensitive zone may be set in a range including a smallest lever operation amount and/or in a range including a largest lever operation amount.

Fourth Embodiment

The combined operation characteristics T3 in the third embodiment are configured such that the capacity decreases in accordance with the boom lowering operation amount. The combined operation characteristics are not limited to the above. Combined operation characteristics may be configured such that the capacity is set to be lower than the capacity based on boom single operation characteristics T1 in a range where the boom lowering operation amount is larger than a reference operation amount E.

Figure 9:
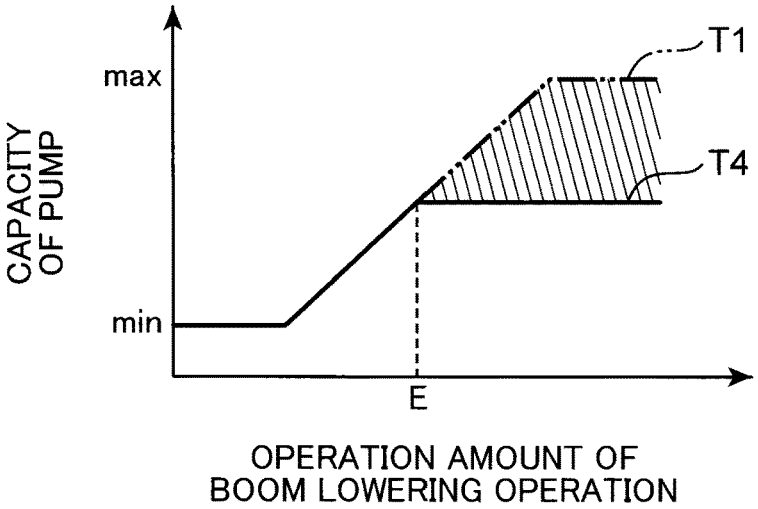
FIG. 9 is a graph illustrating combined operation characteristics in a fourth embodiment of the invention.

For instance, in a range where the boom lowering operation amount is smaller than the reference operation amount E, combined operation characteristics T4 illustrated in FIG. 9 are configured such that the capacity increases as the boom lowering operation amount increases. On the other hand, the combined operation characteristics T4 are configured such that the capacity is fixed in a range where the boom lowering operation amount is larger than the reference operation amount E.

According to the aforementioned configuration, even when the capacity is determined based on the combined operation characteristics T4, it is possible to save energy, as compared with a case, in which the capacity is set based on the boom single operation characteristic T1.

The aforementioned embodiments mainly include the invention having the following features.

In order to solve the above problem, the invention provides a hydraulic control device including a boom attached to a base machine to be operable to be raised and lowered by pivotal movement around a boom foot pin; an arm attached to a distal end of the boom to be operable to be pushed and pulled; a boom cylinder for raising and lowering the boom; an arm cylinder for pushing and pulling the arm; a first hydraulic pump and a second hydraulic pump as a hydraulic source of the boom cylinder and of the arm cylinder; a boom cylinder circuit for connecting the first hydraulic pump and the boom cylinder; an arm cylinder circuit for connecting the second hydraulic pump and the arm cylinder; a boom control valve disposed in the boom cylinder circuit, and configured to control supply and discharge of hydraulic oil to and from the boom cylinder; an arm control valve disposed in the arm cylinder circuit, and configured to control supply and discharge of hydraulic oil to and from the arm cylinder; a boom operation means for operating the boom control valve; an arm operation means for operating the arm control valve; a merging circuit connected to the boom cylinder circuit at a branch connection point upstream of the boom control valve in a state that the merging circuit is branched from the boom cylinder circuit, and configured to cause hydraulic oil discharged from the first hydraulic pump to merge with the arm cylinder; a boom operation detector for detecting a presence or absence of a boom lowering operation by the boom operation means; an arm operation detector for detecting a presence or absence of an arm pushing operation by the arm operation means; a merge switching valve disposed between the branch connection point of the merging circuit and the boom control valve in the boom cylinder circuit, and configured to be switchable between a supply position at which hydraulic oil is suppliable from the first hydraulic pump to the boom control valve, and a blocking position at which supply of hydraulic oil is blocked; a replenishing circuit having a replenishing valve for replenishing hydraulic oil in a tank to a rod side chamber of the boom cylinder; and a controller for switching the merge switching valve to the blocking position when a combined operation of a boom lowering operation and an arm pushing operation is detected by the boom operation detector and the arm operation detector.

According to the invention, when a combined operation of a boom lowering operation and an arm pushing operation is detected, the merge switching valve is switched to the blocking position. This makes it possible to stop supply of hydraulic oil from the first hydraulic pump to the boom control valve (boom cylinder), and to securely cause hydraulic oil from the first hydraulic pump to merge with the arm cylinder via the merging circuit when the combined operation is performed.

Therefore, for instance, when a dump operation is performed by a hydraulic excavator, it is possible to sufficiently accelerate an arm pushing operation. Further, it is not necessary to excessively increase the capacity of the first hydraulic pump (power of the first hydraulic pump). This is advantageous in energy saving.

In a state that the merge switching valve is switched to the blocking position, supply of hydraulic oil from the first hydraulic pump to the rod side chamber of the boom cylinder is stopped. Thus, it is possible to suck hydraulic oil from a tank into the rod side chamber of the boom cylinder by the replenishing circuit having the replenishing valve for replenishing hydraulic oil. This makes it possible to perform a boom lowering operation, while preventing cavitation.

On the other hand, for instance, when an operation other than a combined operation of a boom lowering operation and an arm pushing operation is performed, switching the merge switching valve to the supply position makes it possible to supply hydraulic oil from the first hydraulic pump to the cylinder being operated.

Preferably, the hydraulic control device may further include a pressure detector for detecting an inner pressure of the rod side chamber of the boom cylinder, wherein the controller is operable to switch the merge switching valve to the blocking position when the combined operation is detected by the boom operation detector and the arm operation detector, and the pressure detected by the pressure detector is equal to or smaller than a predetermined reference pressure, and switch the merge switching valve to the supply position when the combined operation is detected by the boom operation detector and the arm operation detector, and the pressure detected by the pressure detector is larger than the predetermined reference pressure.

According to the aspect, it is possible to securely perform an operation of requiring a force acting in a boom lowering direction (operation of exerting load on a boom cylinder), out of the operations to be performed by a combined operation of a boom lowering operation and an arm pushing operation.

For instance, when a ground leveling operation is performed on a slope (descending slope), a bucket is moved along the slope while performing a combined operation of a boom lowering operation and an arm pushing operation. In this case, since it is necessary to press the bucket against the slope, a force acting in a boom lowering direction is required. Therefore, according to the aspect, when the aforementioned work is performed, it is possible to securely control the boom cylinder to perform the work.

In the hydraulic control device, preferably, the first hydraulic pump may be a capacity variable hydraulic pump. The boom operation detector may be operable to detect an operation amount of the boom operation means. The controller may control a capacity of the first hydraulic pump, based on boom single operation characteristics such that the capacity increases as the operation amount of the boom operation means increases when the boom lowering operation is performed alone. The controller may restrict the capacity of the first hydraulic pump to be set smaller than the capacity when the boom lowering operation is performed alone, when a boom lowering operation amount detected by the boom operation detector is larger than a predetermined reference operation amount in a condition that the merge switching valve is switched to the blocking position.

In capacity control based on the boom single operation characteristics, the capacity of the first hydraulic pump increases, as the boom lowering operation amount increases. However, as described above, in a condition that the merge switching valve is switched to the blocking position, supply of hydraulic oil to the boom cylinder is stopped. Therefore, restricting the capacity of the first hydraulic pump to be smaller than the capacity when the boom lowering operation is performed alone, when the boom lowering operation amount is larger than the reference operation amount, makes it possible to prevent an excessive flow of hydraulic oil to be discharged for operating the boom cylinder. This is advantageous in saving energy.

Preferably, the controller may determine the capacity of the first hydraulic pump based on combined operation characteristics such that the capacity decreases as the operation amount of the boom operation means increases in the condition that the merge switching valve is switched to the blocking position, and the combined operation characteristics may be set such that a relationship between the operation amount of the boom operation means and the capacity in the boom single operation characteristics is inverted with respect to the predetermined reference operation amount.

According to the aspect, it is possible to restrict the capacity of the first hydraulic pump when the boom lowering operation amount is larger than the reference operation amount.

On the other hand, the capacity based on the combined operation characteristics is set to be large in a range where the boom lowering operation amount is smaller than the reference operation amount. This makes it possible to prevent a sharp decrease in the capacity of the first hydraulic pump when the boom operation means is operated in a direction of slightly lowering the boom from a non-operation state in a state that an arm pushing operation amount is large.

In the hydraulic control device, preferably, the arm operation detector may be operable to detect an operation amount of the arm operation means. The controller may set, as the capacity of the first hydraulic pump, a lower capacity out of the capacity based on arm single operation characteristics such that the capacity increases as the operation amount of the arm operation means increases, and the capacity based on the combined operation characteristics in the condition that the merge switching valve is switched to the blocking position.

According to the aspect, it is possible to further decrease the capacity of the first hydraulic pump when the operation amount of the arm operation means is small. This is advantageous in enhancing the energy saving effect.

On the other hand, even when the operation amount of the arm operation means is large, in some cases, the capacity of the first hydraulic pump is restricted to be small depending on the operation amount of the boom operation means. This control is performed in order to simulate a state that hydraulic oil is excessively supplied from the first hydraulic pump to the boom cylinder, like a conventional art. With the aforementioned control, it is possible to provide the operator with substantially the same sensation as if the operator is operating the construction machine in a conventional manner, while securing energy saving effect.

Further, the invention provides a construction machine including a base machine; a boom attached to the base machine to be operable to be raised and lowered by pivotal movement around a boom foot pin; an arm attached to the boom to be operable to be pushed and pulled; and the hydraulic control device configured to control an operation of the boom and an operation of the arm.

The invention claimed is:

1. A hydraulic control device, comprising:

a boom attached to a base machine to be operable to be raised and lowered by pivotal movement around a boom foot pin;

an arm attached to a distal end of the boom to be operable to be pushed and pulled;

a boom cylinder for raising and lowering the boom;

an arm cylinder for pushing and pulling the arm;

a first hydraulic pump and a second hydraulic pump as a hydraulic source of the boom cylinder and of the arm cylinder;

a boom cylinder circuit for connecting the first hydraulic pump and the boom cylinder;

an arm cylinder circuit for connecting the second hydraulic pump and the arm cylinder;

a boom control valve disposed in the boom cylinder circuit, and configured to control supply and discharge of hydraulic oil to and from the boom cylinder;

an arm control valve disposed in the arm cylinder circuit, and configured to control supply and discharge of hydraulic oil to and from the arm cylinder;

a boom operator by which the boom control valve is operated;

an arm operator by which the arm control valve is operated;

a merging circuit connected to the boom cylinder circuit at a branch connection point upstream of the boom control valve, and configured to cause hydraulic oil discharged from the first hydraulic pump to merge with the arm cylinder;

a boom operation detector for detecting a presence or absence of a boom lowering operation by the boom operator;

an arm operation detector for detecting a presence or absence of an arm pushing operation by the arm operator;

a merge switching valve disposed between the branch connection point of the merging circuit and the boom control valve in the boom cylinder circuit, and configured to be switchable between a supply position at which hydraulic oil is suppliable from the first hydraulic pump to the boom control valve, and a blocking position at which supply of hydraulic oil is blocked;

a replenishing circuit including a replenishing valve for replenishing hydraulic oil in a tank to a rod side chamber of the boom cylinder; and a controller for switching the merge switching valve to the blocking position when a combined operation of the boom lowering operation and the arm pushing operation is detected by the boom operation detector and the arm operation detector.

2. The hydraulic control device according to claim 1, further comprising:

a pressure detector for detecting an inner pressure of the rod side chamber of the boom cylinder, wherein the controller is operable to switch the merge switching valve to the blocking position when the combined operation is detected by the boom operation detector and the arm operation detector, and the pressure detected by the pressure detector is equal to or smaller than a predetermined reference pressure, and switch the merge switching valve to the supply position when the combined operation is detected by the boom operation detector and the arm operation detector, and the pressure detected by the pressure detector is larger than the predetermined reference pressure.

3. The hydraulic control device according to claim 1, wherein the first hydraulic pump is a capacity variable hydraulic pump, the boom operation detector is operable to detect an operation amount of the boom operator, the controller controls a capacity of the first hydraulic pump, based on boom single operation characteristics such that the capacity increases as the operation amount of the boom operator increases when the boom lowering operation is performed alone, and the controller restricts the capacity of the first hydraulic pump to be set smaller than the capacity when the boom lowering operation is performed alone, when a boom lowering operation amount detected by the boom operation detector is larger than a predetermined reference operation amount in a condition that the merge switching valve is switched to the blocking position.

4. The hydraulic control device according to claim 3, wherein the controller determines the capacity of the first hydraulic pump based on combined operation characteristics such that the capacity decreases as the operation amount of the boom operator increases in the condition that the merge switching valve is switched to the blocking position, and the combined operation characteristics are set as characteristics such that a relationship between the operation amount of the boom operator and the capacity in the boom single operation characteristics is inverted with respect to the predetermined reference operation amount.

5. The hydraulic control device according to claim 4, wherein the arm operation detector is operable to detect an operation amount of the arm operator, and the controller sets, as the capacity of the first hydraulic pump, a lower capacity out of the capacity based on arm single operation characteristics such that the capacity increases as the operation amount of the arm operator increases, and the capacity based on the combined operation characteristics in the condition that the merge switching valve is switched to the blocking position.

6. A construction machine, comprising:

a base machine;

a boom attached to the base machine to be operable to be raised and lowered by pivotal movement around a boom foot pin;

an arm attached to the boom to be operable to be pushed and pulled; and a hydraulic control device configured to control an operation of the boom and an operation of the arm, the hydraulic control device including:

a boom cylinder for raising and lowering the boom;

an arm cylinder for pushing and pulling the arm, a first hydraulic pump and a second hydraulic pump as a hydraulic source of the boom cylinder and of the arm cylinder;

a boom cylinder circuit for connecting the first hydraulic pump and the boom cylinder;

an arm cylinder circuit for connecting the second hydraulic pump and the arm cylinder;

a boom control valve disposed in the boom cylinder circuit, and configured to control supply and discharge of hydraulic oil to and from the boom cylinder;

an arm control valve disposed in the arm cylinder circuit, and configured to control supply and discharge of hydraulic oil to and from the arm cylinder;

a boom operator by which the boom control valve is operated;

an arm operator by which the arm control valve is operated;

a merging circuit connected to the boom cylinder circuit at a branch connection point upstream of the boom control valve, and configured to cause hydraulic oil discharged from the first hydraulic pump to merge with the arm cylinder;

a boom operation detector for detecting a presence of absence of a boom lowering operation by the boom operator;

an arm operation detector for detecting a presence or absence of an arm pushing operation by the arm operator;

a merge switching valve disposed between the branch connection point of the merging circuit and the boom control valve in the boom cylinder circuit, and configured to be switchable between a supply position at which hydraulic oil is suppliable from the first hydraulic pump to the boom control valve, and a blocking position at which supply of hydraulic oil is blocked;

a replenishing circuit including a replenishing valve for replenishing hydraulic oil in a tank to a rod side chamber of the boom cylinder; and a controller for switching the merge switching valve to the blocking position when a combined operation of the boom lowering operation and the arm pushing operation is detected by the boom operation detector and the arm operation detector.

* * * * *